US007223136B2

(12) United States Patent
Yamamoto et al.

(10) Patent No.: US 7,223,136 B2
(45) Date of Patent: May 29, 2007

(54) CONDENSER MICROPHONE AND METHOD FOR MANUFACTURING SUBSTRATE FOR THE SAME

(75) Inventors: Akira Yamamoto, Nara (JP); Yasuo Sugimori, Nabari (JP)

(73) Assignee: Hosiden Corporation, Osaka (JP)

( * ) Notice: Subject to any disclaimer, the term of this patent is extended or adjusted under 35 U.S.C. 154(b) by 0 days.

(21) Appl. No.: 11/262,093

(22) Filed: Oct. 28, 2005

(65) Prior Publication Data

US 2006/0093168 A1 May 4, 2006

(30) Foreign Application Priority Data

Nov. 2, 2004 (JP) ..... 2004-319693

(51) Int. Cl.
*H01R 4/02* (2006.01)

(52) U.S. Cl. ..... 439/876

(58) Field of Classification Search ..... 439/874–876
See application file for complete search history.

(56) References Cited

U.S. PATENT DOCUMENTS 4,340,915 A * 7/1982 Nakamura et al. ..... 360/61
2006/0093168 A1* 5/2006 Yamamoto et al. ..... 381/176
2006/0104468 A1* 5/2006 Yamamoto et al. ..... 381/361
2006/0137455 A1* 6/2006 Yasuda et al. ..... 73/652
2006/0205244 A1* 9/2006 Shigeno et al. ..... 439/67

FOREIGN PATENT DOCUMENTS

JP 2003-153392 5/2003

* cited by examiner

*Primary Examiner*—James R. Harvey
(74) *Attorney, Agent, or Firm*—David N. Lathrop, Esq.; Gallagher & Lathrop

(57) ABSTRACT

A substrate is obtained as follows. A structure is formed using a metal plate for a lead frame on which terminals and connection portions are formed; the terminals are exposed from either a front or back surface and the connection portions connect the terminals together. A resin is then used to make the structure hard. The height of a step in a central step portion is variable. The resin is one of PA6T, PPS, and LCP, all of which are resistant to heat. A step portion can be obtained which projects from a bottom surface of a circuit substrate. The circuit substrate is inexpensively obtained.

10 Claims, 7 Drawing Sheets

PRIOR ART

CONDENSER MICROPHONE AND METHOD FOR MANUFACTURING SUBSTRATE FOR THE SAME

BACKGROUND OF THE INVENTION

1. Field of the Invention

The present invention relates to a condenser microphone and a method for manufacturing a substrate used for the condenser microphone.

2. Description of the Related Art

A related art will be described below taking the case of what is called a back electret type electret condenser microphone (referred to as an ECM below). FIG. 1 shows a sectional configuration of an ECM in accordance with the related technique, which is described in Japanese Patent Application Laid Open No. 2003-153392. In FIG. 1, the contour of the ECM is formed by a cylindrical capsule 61. A sound wave passing opening 610 is formed in a front plate 61*a* of the capsule 61. The following are incorporated into the capsule 61 and arranged in the following order from an inner surface of the front plate 61*a* toward the rear of the capsule 61: a diaphragm 62, an insulating spacer 63, a rear pole 64, a ring-like rear pole holder 65 consisting of an insulating material, a conductive cylinder 66, and a circuit substrate 67. In this case, the diaphragm 62 comprises a dielectric film which consists of for example, polyphenylene sulfide (also referred to as PPS) and in which a metal film such as Ni or Al is formed, as a conductive layer, on a surface of the film located closer to the rear pole. A diaphragm ring 62*a* is fixed to the periphery of a front surface of the diaphragm 62 and is in contact with the front plate 61*a*. The rear pole 64 is placed behind the diaphragm 62 via the thickness of the insulating spacer 63 and supported by the ring-like rear pole holder 65, consisting of an insulating material. A conductive cylinder 66 is interposed between the rear pole 64 and the circuit substrate 67 to electrically connect the rear pole 64 to wiring formed on a top surface (front surface) of the circuit substrate 67. An electret layer 64*a* is formed on a front surface of the rear pole 64, that is, the surface of the rear pole 64 located opposite the diaphragm 62; the electret layer 64*a* is obtained by converting a dielectric layer such as FEP (Fluorinated Ethylene Propylene) into an electret. A circuit device 68 such as an FET (Field Effect Transistor) is mounted on a top surface of the circuit substrate 67. Solder bump electrodes 69*a* and 69*b* that are externally connected electrodes are projected from a bottom surface (rear surface) of the circuit substrate 67. For example, such a circuit as shown in FIG. 2 is formed on the circuit substrate 67. In FIG. 2, a gate of the FET is connected to the rear pole 64 through the conductive cylinder 66, shown in FIG. 1. A source of the FET is connected to the diaphragm 62 through the capsule 61, shown in FIG. 1. Two capacitors C are connected to between a source and a drain of the FET in parallel with each other; the part between the source and drain of the FET operates as an impedance converting section. The drain of the FET is connected to an output terminal 72 (in FIG. 1, the solder bump electrode 69*b*) through a through-hole (not shown in the drawings) formed in the circuit substrate 67. The drain of the FET then leads to a DC inhibiting capacitor Cp. The source of the FET is connected to a ground terminal 71 (in FIG. 1, the solder bump electrode 69*a*) through a through-hole (not shown in the drawings) formed in the circuit substrate 67. Further, the drain of the FET is connected to a reference power source through a resistance element R. In FIG. 1, a rear (back face-side) end of the capsule 61 is caulked to the rear surface of the circuit substrate 67 as a caulking portion 611. The caulking allows element parts housed in the capsule 61 to be fixed to one another. If a sound wave enters the capsule 61 through the sound wave passing opening 610, it vibrates the diaphragm 62 to change the capacitance between the diaphragm 62 and the rear pole 64. This converts the sound wave into an electric signal, which is output to the output terminal 72 (in FIG. 1, the solder bump electrode 69*b*).

To mount the above ECM on a mounting substrate (not shown in the drawings), the solder bump electrodes 69*a* and 69*b* are soldered to the corresponding electrodes on the mounting substrate. That is, the ECM placed on the entire mounting substrate is passed through a reflow bath and then heated. The heating melts the solder bump electrodes 69*a* and 69*b* to achieve soldering. In this case, as shown particularly in FIG. 1, the solder bump electrodes 69*a* and 69*b* are projected from the bottom surface of the circuit substrate 67, with the caulking portion 611 present on the bottom surface of the circuit substrate 67 at an end of the capsule 61. This configuration presents the problem described below. When the solder is heated and melted in the reflow bath, solder melting heat distorts the caulking portion 611. This may relax the caulking or cause the molten solder and fluxes to advance between the caulking portion 611 and the circuit substrate 67. This may make the electric connection between the rear pole 64 and the wiring on the circuit substrate 67 unstable; the conductive cylinder 66 is interposed between the rear pole 64 and the wiring. The electret layer 64*a* of the rear pole 64 may be degraded to reduce the voltage applied to between the diaphragm 62 and the rear pole 64. Further, the sensitivity of the ECM may decrease.

With the reflow type ECM for which soldering is carried out using a reflow bath, the measure described below is taken to prevent solder or fluxes from advancing between the caulking portion 611 and the circuit substrate 67. If the mounting substrate is directly soldered, solder paste is accumulated between the caulking portion 611 and the mounting substrate. The caulking portion 611 is thus separated from the mounting substrate before soldering. However, this measure is not reliable.

Another measure involves applying a second substrate to the bottom surface of the circuit substrate 67 to form such a step as projects beyond the thickness of the caulking portion 611. A solder bump electrode is then projected from the substrate. Then, the solder is connected to the mounting substrate in the reflow bath. This amounts to the application of the substrate to the circuit substrate 67 resulting in the formation of a step. The application of the substrate to the circuit substrate 67 requires alignment at a predetermined accuracy and the formation of a through-hole for electric connection followed by an attachment operation. However, these operations preclude inexpensive circuit substrate from being obtained. Further, even if a circuit substrate is obtained by using a router to carry out machining to form a step, disadvantageously the resulting circuit substrate is not inexpensive. That is, structures with steps are expensive.

Moreover, conventional circuit substrates are mostly pattern wired substrates. Fabrication of a pattern wired substrate requires production of conductor electrodes, glass, multilayer wiring, through-holes, and the like using various materials and various printing processes. Consequently, the fabrication process is complicated and expensive.

SUMMARY OF THE INVENTION

It is an object of the present invention to provide a condenser microphone which minimizes the adverse effect of heating in a reflow bath to preclude relaxing of a caulking portion and thus the entry of solder and fluxes into the caulking portion, thus prevent electric instability and a decrease in the sensitivity, as well as a method for manufacturing a substrate for the condenser microphone. It is another object of the present invention to provide a condenser microphone which is made reliable by separating the caulking portion from a mounting substrate by using a step rather than accumulating solder paste, as well as a method for manufacturing a substrate for the condenser microphone. It is another object of the present invention to provide a condenser microphone which allows an inexpensive substrate to be obtained without using a router to carry out machining to form a step, as well as a method for manufacturing a substrate for the condenser microphone. It is another object of the present invention to provide a condenser microphone which allows a substrate to be obtained without using various materials or various printing processes, that is, without executing a complicated and expensive manufacturing process.

The present invention relates to a substrate comprising a planar periphery portion, a central step portion which is projected from the planar periphery portion toward a mounted surface side and which comprises an external terminal located in a part of the central step portion and a ground terminal located in another part of the central step portion and insulated from the external terminal, an apparatus connection terminal provided on a parts mounted surface side of the planar periphery portion and comprising a connection terminal connected to the external terminal of the central step portion and another connection terminal insulated from the above connection terminal and connected to a ground terminal, and a resin mold portion formed by exposing mounted surface sides of the external terminal of the central step portion and the ground terminal, exposing surfaces of the apparatus connection terminal and another external terminal which are located opposite their mounted surfaces, and then filling resin into the exposed portions. The substrate simply comprises the resin mold portion obtained by using resin to mold the planar periphery portion, central step portion, the apparatus connection portion, all of which consist of for example, a metal plate for a lead frame; these portions are used as a skeleton. Thus, the present substrate requires a simpler manufacturing process and is more inexpensive than the conventional pattern wired substrate. Further, the present substrate consists only of the metal and resin and thus contributes to environmental protection. Moreover, in the central step portion, the step portion is formed which projects from the bottom surface. Consequently, when the caulking portion is located on the bottom surface of the substrate, the step enables the caulking portion to float from the mounted surface. It is thus possible to hinder the caulking portion from being adversely affected by heat resulting from reflow and to prevent the flow-in of solder and fluxes, without accumulating solder paste, which is conventionally unreliable, stacking substrates, or performing an expensive step forming operation such as one using a router. Therefore, a microphone can be obtained the sensitivity of which is subject to few variations.

DETAILED DESCRIPTION OF THE PREFERRED EMBODIMENT(S)

An embodiment of the present invention will be described with reference to the drawings. Description will be given by taking the case of a back electret type electret condenser microphone (ECM). However, the present invention is applicable to what is called a front electret ECM.

In the present embodiment, a substrate is obtained by using resin to fix a structure constructed by connecting a planar periphery portion, a central step portion, and an apparatus connection terminal which are formed by punching and folding metal plate for a lead frame.

Figure 3A:
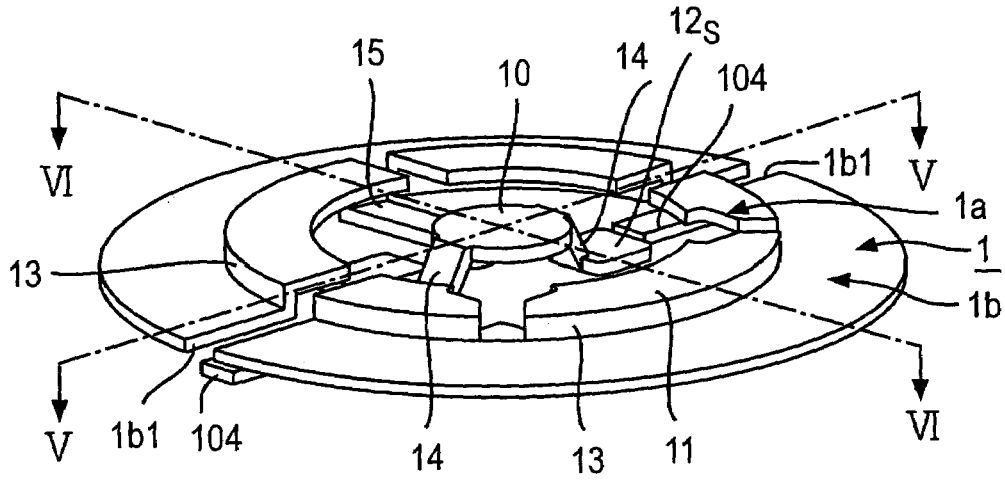
FIG. 3A is a perspective view of an example of a structure in accordance with an embodiment of the present invention as viewed from obliquely above.
Figure 3B:
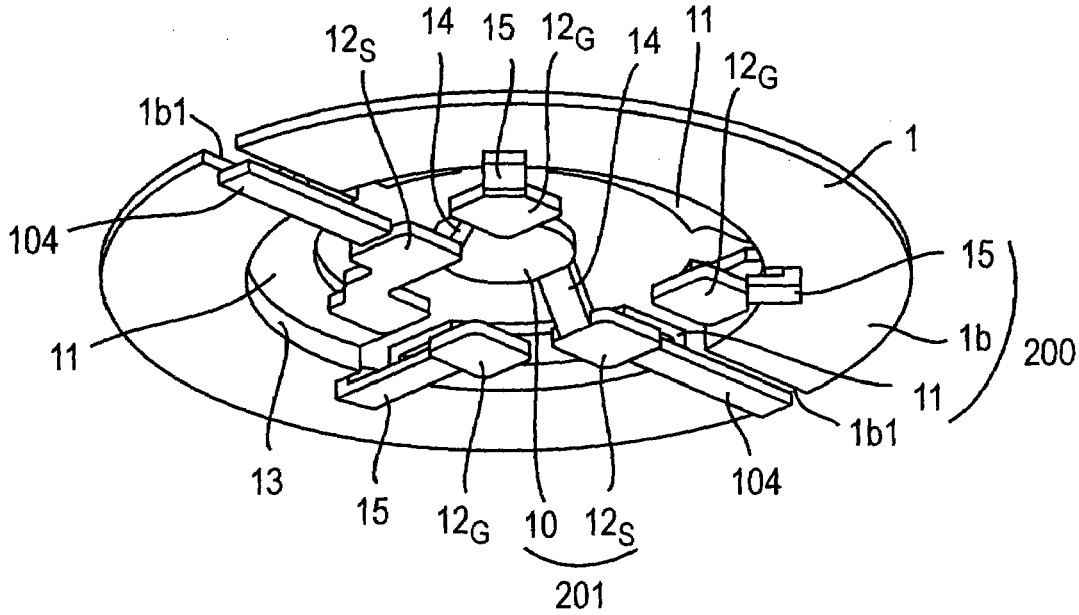
FIG. 3B is a perspective view of an example of the structure in accordance with the embodiment of the present invention as viewed from obliquely below.

FIG. 3 shows a structure 1 obtained by punching and folding a metal plate for a lead frame which consists of brass or phosphor bronze pre-plated with tin or silver. FIG. 3A is a perspective view of the structure 1 as viewed from obliquely above. FIG. 3B is a perspective view of the structure 1 as viewed from obliquely below. As shown in FIG. 3A, on a mounted surface side of the structure 1 which corresponds to its front surface, the structure 1 has a planar central step portion 1*a* projecting toward the mounted surface side and a planar periphery portion 1*b* located around the periphery of the central step portion 1*a* which corresponds to the root of the central step portion 1*a*; the planar periphery portion 1*b* is one step lower than the central step portion 1*a*. The central step portion 1*a* has an external terminal 10 formed in its center like a disk and a ground (GND) terminal 11 located around the external terminal 10 and separated (insulated) from the external terminal 10. The planar periphery portion 1*b* is a ground terminal integrated with the ground terminal 11 of the central step portion 1*a* via a step 13. Further, as shown in FIG. 3B, five connection terminals 12 ($\mathbf{12}_S$, $\mathbf{12}_G$) are formed on a parts mounted surface side of the structure 1 which corresponds to its back surface. These connection terminals 12 are located substantially between the external terminal 10 and the ground terminal 11 and project from the planar periphery portion 1*b* toward the parts mounted surface side. A part $\mathbf{12}_S$ of the five connection terminals 12 is connected, inside the structure 1, to the external terminal 10 via a bent portion 14. The other part $\mathbf{12}_G$ of the connection terminals 12 is connected to the planar peripheral portion 1*b* via a bent portion 15. In this manner, the structure 1 is configured so that the external terminal 10 and the ground terminal 11 project toward the mounted surface side and so that the connection terminal ($\mathbf{12}_S$, $\mathbf{12}_G$) project toward the parts mounted surface side, with reference to the position of the planar periphery portion 1*b*.

Further, as shown in FIG. 3A, the step 13 is formed so that the center of the structure 1 rises from the planar periphery portion 1*b*, thus constituting a central step portion 1*a*. The planar periphery portion 1*b* constitutes a donut-shaped ground terminal. In this case, the step 13 is formed by punching and folding a metal plate for a lead frame. Consequently, the height of the step 13 can be freely increased or reduced.

Figure 4:
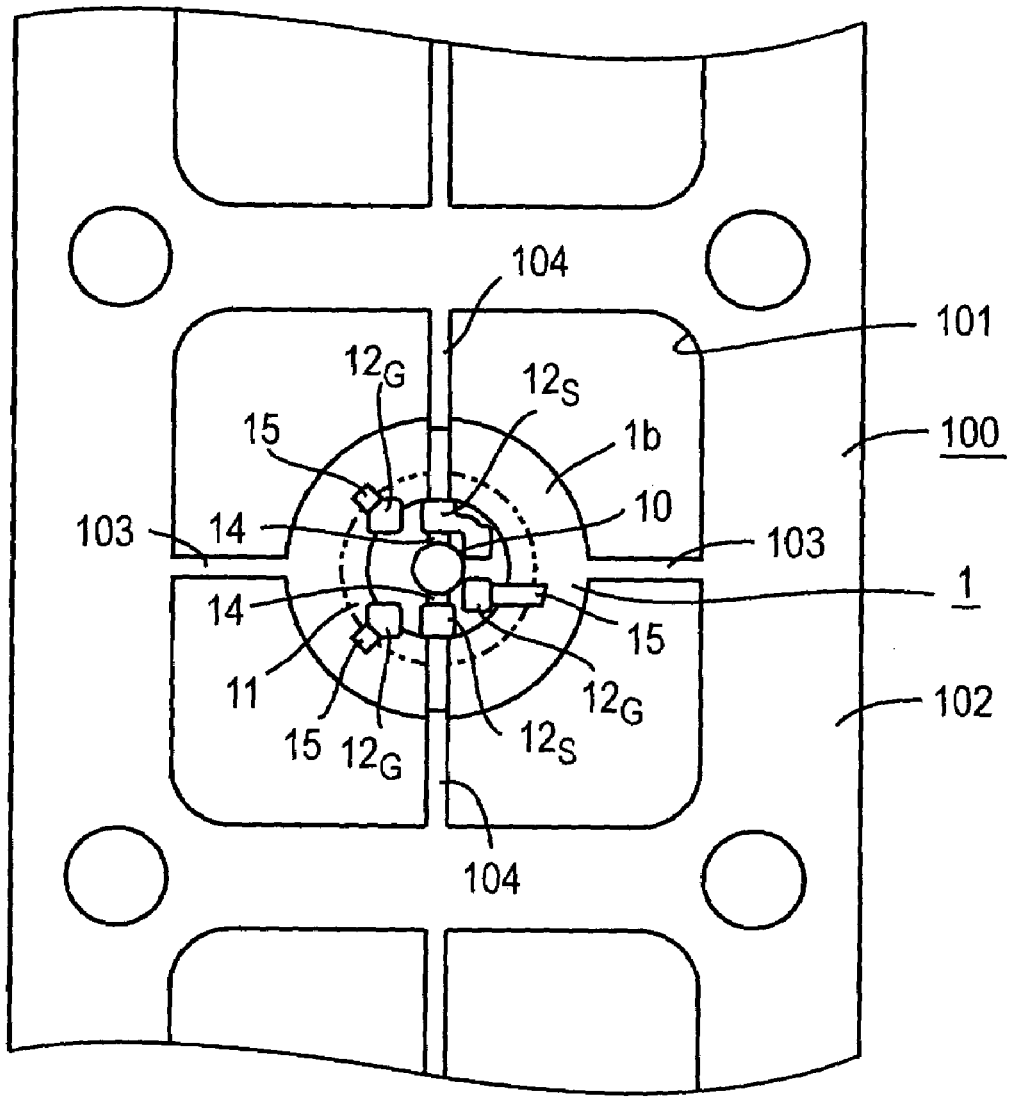
FIG. 4 is a plan view of an example of punching of a metal plate.

FIG. 4 shows how a metal plate is cut using a mold to form a structure when a substrate is manufactured in accordance with the present embodiment. In this case, the structure 1 is arranged and formed along a longitudinal direction of a band-like metal plate 100 for a lead frame which consists of brass or phosphor bronze. That is, in a part of the metal plate 100 in which the metal plate 100 is to be formed, a square slot 101 is punched with the planar periphery portion 1*b*, ground terminal 11, external terminal 10, connection terminals $\mathbf{12}_S$ and $\mathbf{12}_G$, and bent portions 14 and 15 left inside the square slot 101 in its central portion. The planar periphery portion 1*b* is connected to a lead frame 102 through thin connection pieces 103 extended in the opposite directions. The connection terminal $\mathbf{12}_S$ is connected to the lead frame 102 through thin connection pieces 104 extended in the opposite directions. Simultaneously with the formation of these connection pieces 104, slits 1*b*1 (see FIG. 3) are formed in the ground terminal 11 and planar periphery portion 1*b*. After the punching, as is apparent from FIGS. 7 and 8, the central step portion 1*a*, consisting of the external terminal 10 and ground terminal 11, is projected from the planar periphery portion 1*b* connected to the ground terminal 11, toward the mounted surface side. Moreover, the connection terminal $\mathbf{12}_G$ is projected, together with the bent portion 15, from the planar periphery portion 1*b* toward the surface side of the structure lying opposite the mounted surface side. At the same time, the connection terminal $\mathbf{12}_S$ connected to the external terminal 10 is projected, via the bent portion 14, toward the surface side of the structure lying opposite the mounted surface side. In this case, the connection pieces 104 are cut off the planar periphery portion 1*b* and projected toward the surface side of the structure lying opposite the mounted surface side, as in the case of the connection terminal $\mathbf{12}_S$. This operation can be performed by for example, molding with a force piston. A common forcing operation involves setting the band-like metal plate 100 flush with the planar periphery portion 1*b* and forcing the external terminal 10 and the ground terminal 11 in one direction, while forcing the connection terminals $\mathbf{12}_S$ and $\mathbf{12}_G$ in the other direction. This allows the external terminal 10, ground terminal 11, and planar periphery portion 1*b* to face the mounted surface side, while allowing the connection terminal $\mathbf{12}_S$ and the other connection terminal $\mathbf{12}_G$ to face the parts mounted surface side.

Figure 5:
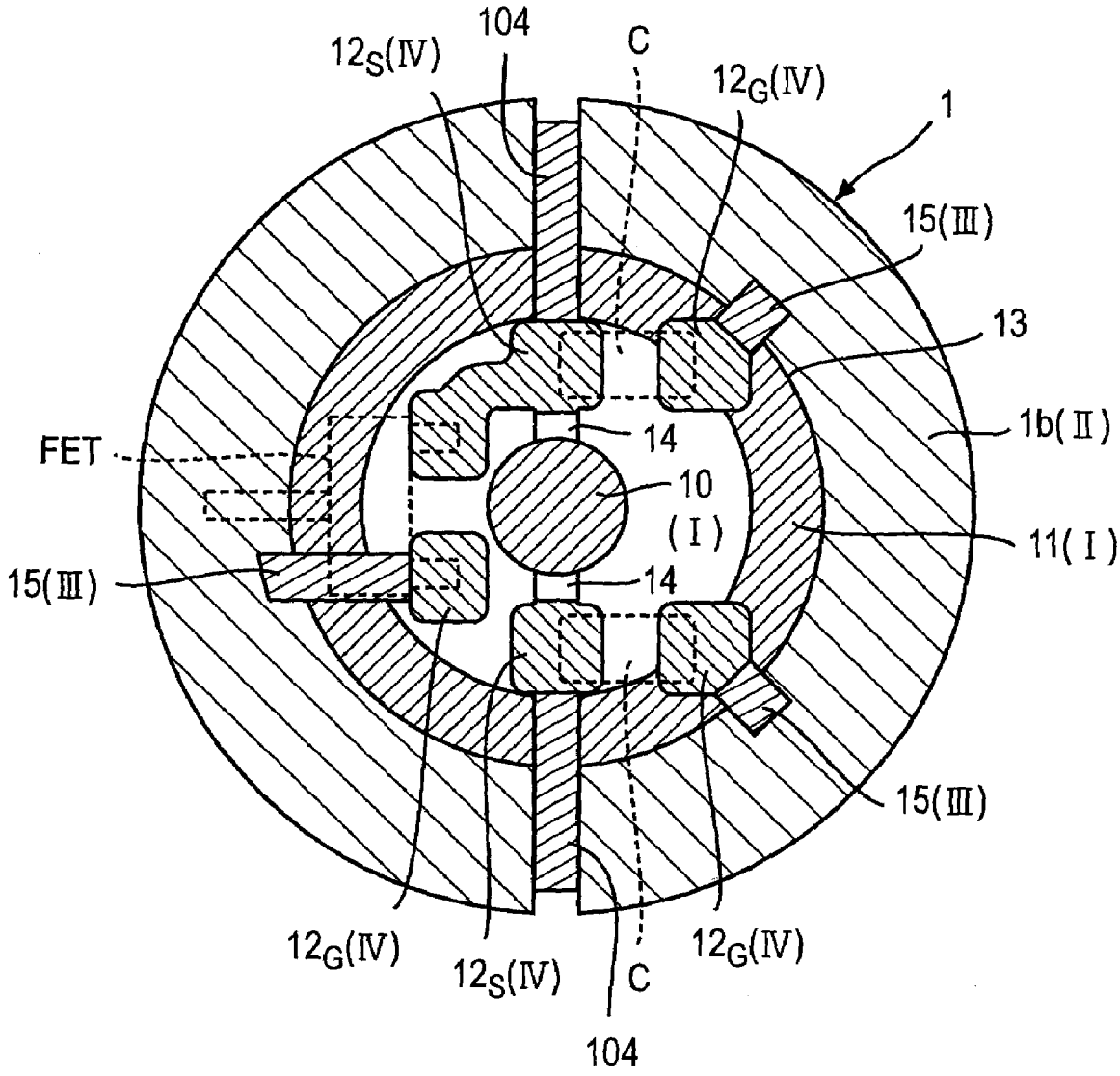
FIG. 5 is a plan view illustrating a planar structure and a three-dimensional structure in accordance with the embodiment of the present invention.

FIG. 5 shows the planar structure of the structure 1 formed by punching and folding the metal plate 100 for a lead frame as described above. FIG. 5 also shows the three-dimensional positions of the terminals and the like except the bent portion 14 on the basis of the direction and width of hatching; the bent portion 14 is present across the thickness of the band-like metal plate. That is, the external terminal 10 and the ground terminal 11 are positioned at a three-dimensional position (I). Then, the planar periphery portion 1*b* is positioned at a three-dimensional position (II) separated by the step 13 from the position (I). Then, mainly the bent portion (connection portion) 15 between the planar periphery portion 1*b* and the connection terminal $\mathbf{12}_G$ and the connection piece 104 are positioned at a three-dimensional position (III). The connection terminals $\mathbf{12}_S$ and $\mathbf{12}_G$, connected to the external terminal 10 and planar periphery portion 1*b*, are positioned at a three-dimensional position (IV) on an exposed surface on the parts mounted surface side. The bent portion 14 is positioned at an oblique three-dimensional position and thus does not correspond to any of the three-dimensional positions (I) to (IV). The dashed line in FIG. 5 shows how an FET and a capacitor C are arranged and connected.

Figure 6A:
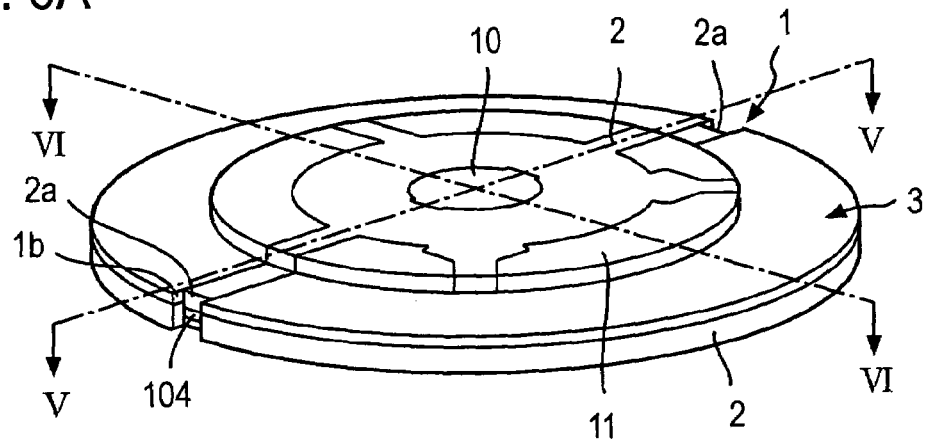
FIG. 6A is a perspective view of an example of a substrate in accordance with the embodiment of the present invention as viewed from obliquely above.
Figure 6B:
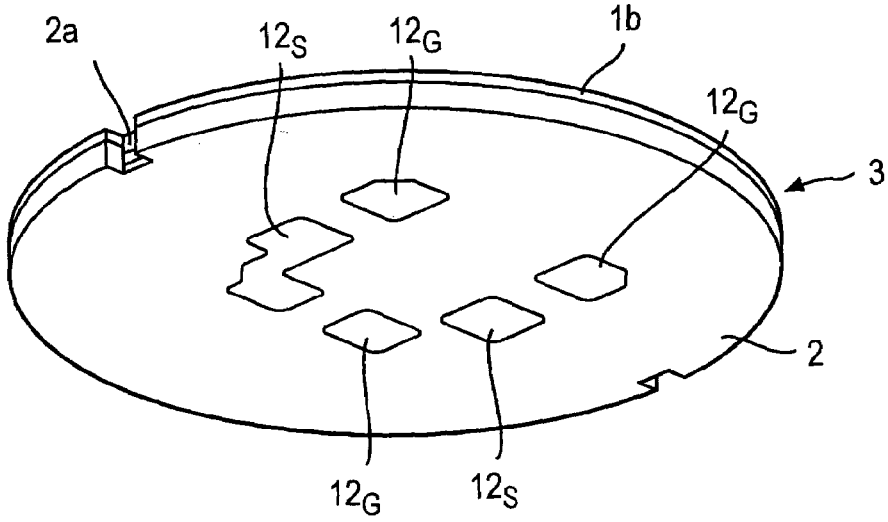
FIG. 6B is a perspective view of an example of the substrate in accordance with the embodiment of the present invention as viewed from obliquely below.
Figure 6C:
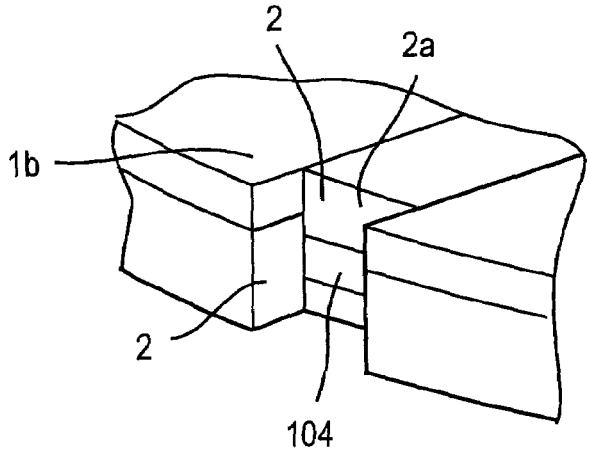
FIG. 6C is a perspective view of a notch portion of the example of the substrate in accordance with the embodiment of the present invention.

The structure 1 is formed by punching and bending the metal plate 100 for a lead frame (see FIG. 4) as previously described. If fine-pitch machining is required to form a fine structure, the metal plate may be bent by etching or cut. FIG. 6 shows a substrate on which a resin mold portion 2 has been formed by using a heat-resistant resin to mold the structure 1 shown in FIG. 3. In FIG. 6, as in the case of FIG. 3, FIG. 6A is a perspective view as viewed from obliquely above, and FIG. 6B is a perspective view as viewed from obliquely below. In the molded substrate, the surface from which the external terminal 10, the ground terminal 11, and the ground terminal corresponding to the planar peripheral portion 1*b* project is exposed from the mounted surface side of the structure 1, which corresponds to its front surface. The connection terminals 12 ($\mathbf{12}_S$ and $\mathbf{12}_G$) are exposed from the parts mounted surface side of the structure 1, which corresponds to its back surface. In this case, the heat-resistant resin of the resin mold portion 2 offers heat resistance enough to resist heating in for example, a reflow bath. Specific examples of the heat-resistant resin include PA6T (polyamide 6T), PPS (polyphenylene sulfide), and LCP (liquid crystal polymer). The formation of the resin mold portion 2 is carried out with the structure 1 connected to the lead frame 102, shown in FIG. 4. After the resin mold portion 2 is formed, the connection piece 103, shown in FIG. 4, is cut at an outer peripheral position of the planar periphery portion 1*b*. The connection piece 104 is cut at position lying slightly inside of the outer periphery of the planar periphery portion 1*b*. The substrate 3 is thus taken out. A notch portion 2*a* is formed in a part of the outer periphery of the planar periphery portion 1*b* to constitute the resin mold portion 2 so that the connection piece 104 can be cut inside the structure as previously described. This is shown in a partly enlarged view in FIG. 6C. The spacing between the connection piece 104, facing the notch portion 2*a*, and the capsule 61 should be minimized to the extent that the insulation between them does not present any problem. This more effectively shields noise.

Thus, the substrate 3 is obtained by molding resin to form a resin mold portion 2 using, as a skeleton, the structure 1 formed by pressing or etching. This eliminates a substrate to which a circuit pattern is applied, such as the one described in the description of the related art. This makes the manufacturing process simple and inexpensive. Further, the materials are only the metal and resin. Accordingly, the present invention contributes to environmental protection.

Figure 1:
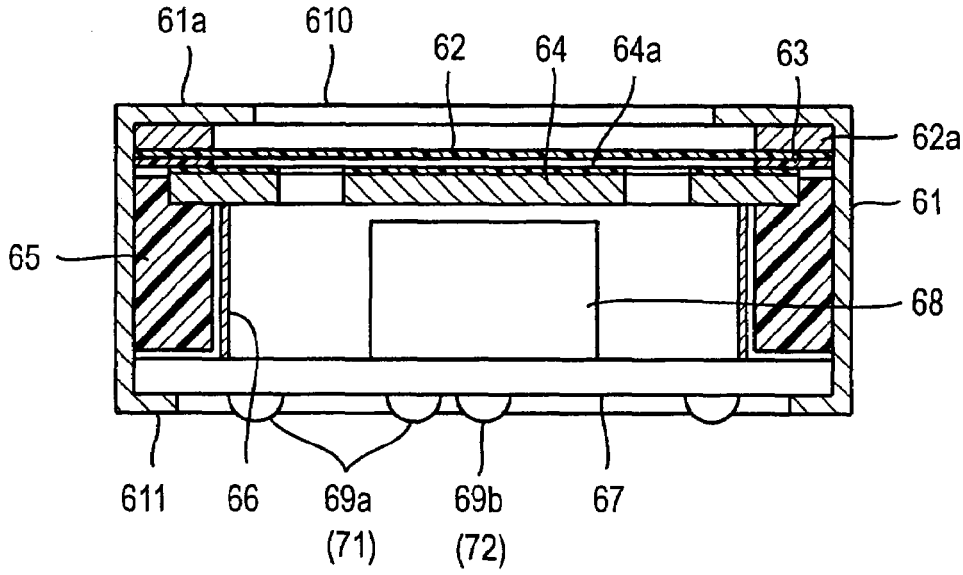
FIG. 1 is a sectional view of a related ECM.
Figure 7:
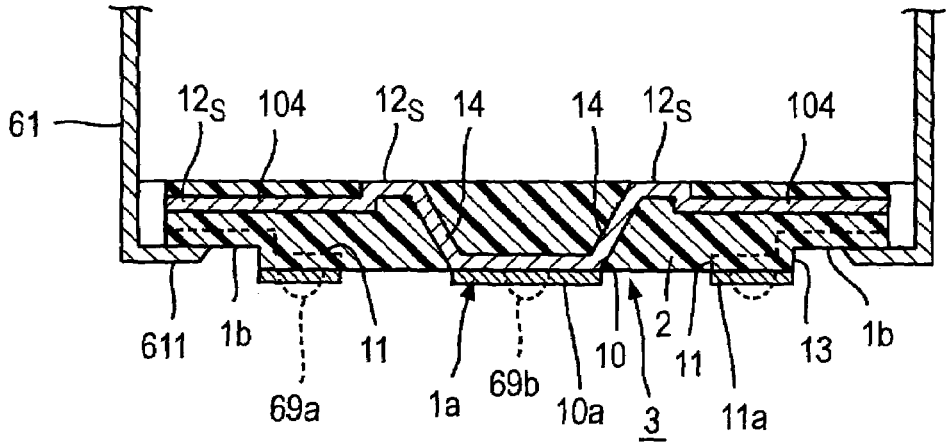
FIG. 7 is a sectional view taken along line V—V in FIG. 3A.
Figure 8:
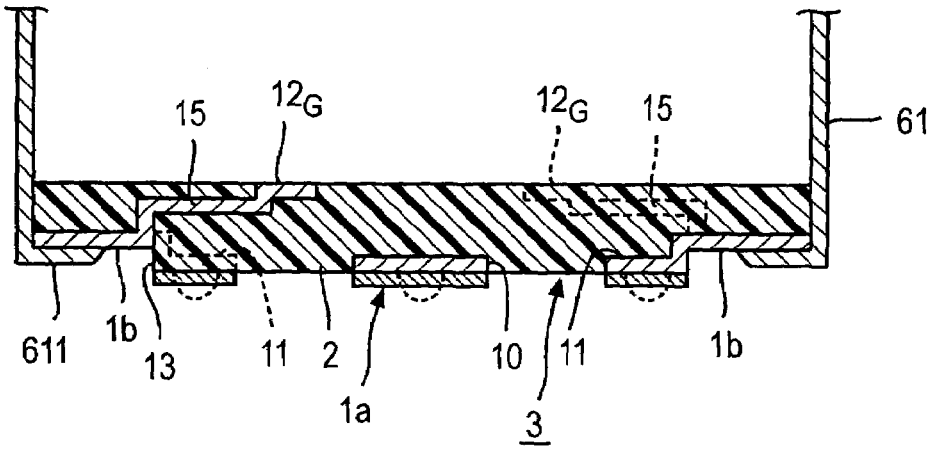
FIG. 8 is a sectional view taken along line VI—VI in FIG. 3A.

For example, the substrate 3 is used in place of the circuit substrate 67 in the ECM shown in FIG. 1. FIGS. 7 and 8 show the relationship between the substrate 3 and the caulking portion 611 of the capsule 61 in that case. FIG. 7 shows a cross section taken along line V—V in FIG. 6A and corresponding to the cross section taken along line V—V in FIG. 3A. FIG. 7 shows how the external terminal 10 is connected to the connection terminal $\mathbf{12}_S$. FIG. 7 also shows that the caulking portion 611 of the capsule 61 is caulked to an outer side of the planar periphery portion 1*b* so as to connect the capsule 61 to the ground terminal 11. Here, the step 13 has a dimension larger than the thickness of the caulking portion 611 of the capsule 61. The connection piece 104 is partly formed to be shorter than the periphery of the planar periphery portion 1*b* so as not to contact the capsule 61 for insulation. A solder layer 10*a* and 11*a* are formed on the front surfaces of the external terminal 10 and ground terminal 11, respectively. The solder layers 10*a* and 11*a* have a thickness of for example, 100 μm. Since the solder layers 10*a* and 11*a* are thus formed, the thickness of the step 13 has only to be equal to or larger than that of the caulking portion 611. The excessively large thickness of the step 13 results in the large height of the mounting substrate on which an ECM has been mounted. To reduce the size of the substrate, the thickness of the step 13 should be minimized. When the caulking portion 611 is 0.15 mm in thickness, the step 13 should be about 0.15 to 0.2 mm in thickness. That is, the distance between the caulking portion 611 and the terminals 10 and 11 in the thickwise direction of the substrate should be about 0 to 0.05 mm. Further, solder bumps 69*a* and 69*b* may be used in place of the solder layers 10*a* and 11*a* as shown by dashed lines.

FIG. 8 shows the relationship between the caulking potion 611 of the capsule 61 and a cross section of the substrate corresponding to the cross sections taken along line VI—VI in FIGS. 3A and 6A. The figure shows that the caulking portion 611 is connected to the planar periphery portion 1*b*, to which the connection terminal $\mathbf{12}_G$ is connected. If the structure 1 is used as a skeleton for a circuit substrate for an ECM, the caulking portion 611 of capsule 61 of the ECM is located in the planar periphery portion 1*b* integrally connected to the ground terminal 11 as shown in FIG. 3A. The caulking portion 611 is located on the mounted surface side of the structure 1 in FIG. 3A, which corresponds to its front surface. Thus, the step 13 is higher than the thickness of an end of the capsule 61 which is caulked to the planar periphery portion 1*b*, that is, the thickness of the caulking portion 611. By projecting the solder layers from the external terminal 10 and ground terminal 11 toward the mounted surface side, it is possible to reduce the adverse effect of heating on the caulking portion 611 during reflow or to prevent the flow-in of solder and fluxes. The circuit substrate 67 of the ECM in FIG. 1 and the structure 1 in FIG. 3 have a positionally opposite relationship. The external terminal 10 of the central step portion 1*a* is located so as to project from the bottom of the ECM shown in FIG. 1, that is, the bottom surface of the caulking portion 611. The planar periphery portion 1*b*, ground terminal 11, connection terminal $\mathbf{12}_G$, and the like constitute a first metal member 200 (see FIG. 3B) formed by folding one plate-like metal. The external terminal 10, connection terminal $\mathbf{12}_S$, and the like constitute a second metal member 201 (see FIG. 3B) formed by folding other plate-like metal. In the figures, the relative dimensions may be inappropriately illustrated in order to show each portion in an easy-to-understand manner. For example, the substrate 3 has a thickness of about 0.2 mm. The metal plate constituting the planar periphery portion 1*b* and the like has a thickness of about 0.15 mm.

Figure 2:
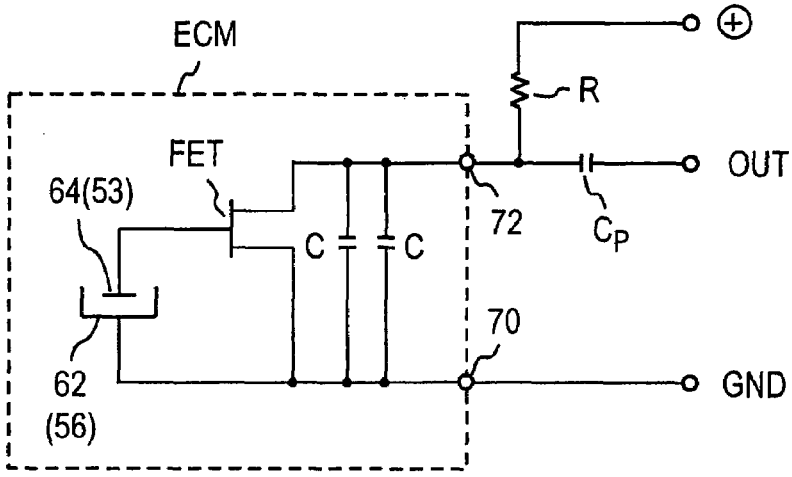
PRIOR ART FIG. 2
FIG. 2 is a circuit diagram of the ECM.
Figure 9:
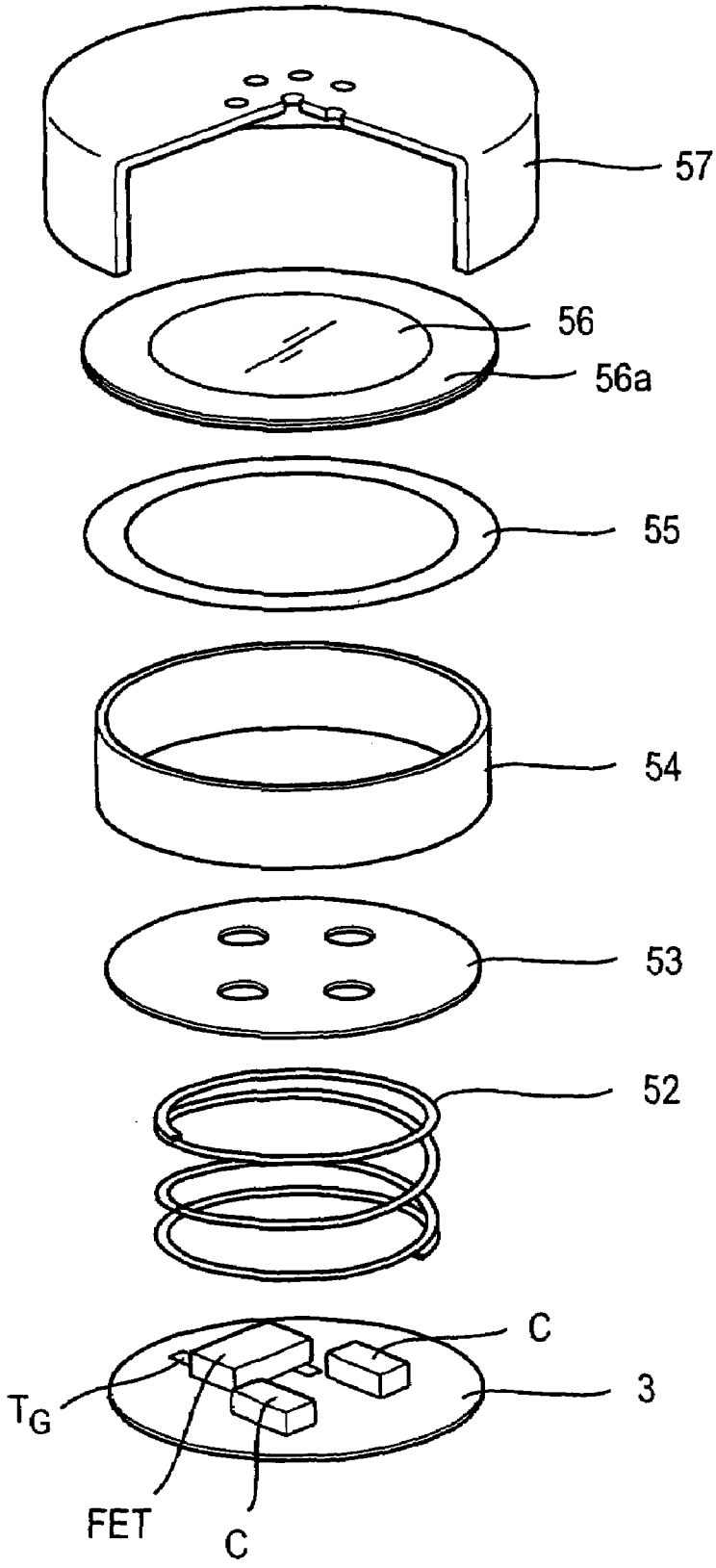
FIG. 9 is an exploded perspective view of an ECM.

FIG. 9 is an exploded perspective view of an ECM formed using the substrate 3, shown in FIGS. 6 to 8. The structure in FIG. 9 is different from that in FIG. 1. Accordingly, even the same portions are denoted by different reference numerals in order to distinguish the structure in FIG. 9 from the structure in FIG. 1. In this exploded perspective view, a rear pole 53 and a coil spring 52 can be housed in a holder 54. The coil spring 52 is interposed between the substrate 3 and the rear pole 53. One of those rings of the coil spring 52 which are closer to the substrate 3 is contacted with a gate terminal $T_G$ of an FET mounted on the connection terminal $\mathbf{12}_S$ on the substrate 3. Thus, when element parts are sealed in the capsule 57, a spring force is exerted to ensure the contact between the gate terminal TG of the FET and the rear pole 53. The coil spring 52 and the rear pole 53 are located in the holder 54. A diaphragm 56 is placed on the holder 54 via a spacer 55. That is, the substrate 3 to which the diaphragm 56, spacer 55, rear pole 53, and coil spring 52 are connected is sequentially incorporated into the capsule 57. An end of the capsule 57 is then caulked to and integrated with the rear surface of the substrate 3. In this case, the diameter of the rear pole 53 is smaller than that of the holder 54. However, the diameter of the rear pole 53 should be increased as long as the rear pole 53 can be easily inserted into the holder 54. This is preferable for the positioning of the rear pole 53. Further, although not shown in FIG. 9, the bottom surface of the substrate 3 has the step 13, described above. Accordingly, in connection with the melting of solder on the bottom surface of the substrate 3 in a reflow bath, the formation of a step projecting from the caulking portion reduces the adverse effect heat on the caulking portion. Consequently, solder and fluxes are prevented from flowing in between the caulking portion and the bottom surface of the substrate 3. If the coil spring 52 is used to press and contact the gate terminal TG with the rear pole 53 to connect them together, a stable spacing is established between the diaphragm and the rear pole without tilting the rear pole 53. In FIG. 9, the FET and the two capacitors C are mounted on the substrate to provide such a circuit configuration as shown in FIG. 2. An output terminal 72 of this circuit is connected to the connection terminal $\mathbf{12}_S$, which leads to the external terminal 10. The ground terminal 71 of circuit is connected to the connection terminal $\mathbf{12}_G$, which leads to the ground terminal 11. The holder 54 electrically connects the coil spring 52 and rear pole 53 to the capsule 57.

The above description is based on the ECM. However, since the height of the step portion can be freely set, the present invention is applicable to a front electret ECM or condenser microphone.

Further, a simple and inexpensive substrate can be easily obtained using only metal and resin as a material, simply by punching and folding a metal plate for a lead frame to form a structure and then using the resin to mold the structure. Therefore, a substrate can be obtained which is totally different from the conventional pattern wired substrate.

What is claimed is:

1. A condenser microphone comprising a metal cylindrical capsule which has a sound wave passing opening formed at one end and in which a substrate 3 is housed, the substrate 3 having at least a diaphragm, a rear pole, and an impedance converting circuit mounted on the substrate 3, the other end of the cylindrical capsule being caulked to an outer surface of the substrate 3 to form a caulking portion 611 to fix parts inside the capsule together, wherein the substrate 3 comprises:

a first metal member 200 formed by folding a plate-like metal having a planar periphery portion 1*b* against which the caulking portion 611 is abutted, a first connection terminal $\mathbf{12}_G$ integrally connected to the planar periphery portion 1*b* and located on an inner surface of the substrate 3, and a ground terminal 11 integrally connected to the planar periphery portion 1*b* and located on the outer surface of the substrate 3 more than the caulking portion 611;

a second metal member 201 formed by folding a plate-like metal having a second connection terminal $\mathbf{12}_S$ located on the inner surface of the substrate 3 and an external terminal 10 integrally connected to the second connection terminal $\mathbf{12}_S$ and located on the outer surface of the substrate 3 and on the same plane as that on which the ground terminal is located; and a resin mold portion 2 which integrates the first metal member 200 with the second metal member 201 and which exposes the first connection terminal $\mathbf{12}_G$ and second connection terminal $\mathbf{12}_S$ in the substrate, the resin mold portion exposing an outer surface of the planar periphery portion 1*b*, the external terminal 10, and the connection terminal 11 from the outer surface of the substrate.

2. The microphone according to claim 1, wherein the external terminal 10 is located in a central portion of the outer surface of the substrate, the ground terminal 11 is a plate ring-like member centered on the external terminal 10, and the planar periphery portion 1*b* is also a plate ring-like member which is located outside the external terminal 10 and which is concentric with the external terminal 10, and each of the ground terminal 11 and the planar periphery portion 1*b* comprises at least two slit portions 1*b*1 cut at least more than one portions in the same radial direction around the external terminal 10.

3. The microphone according to claim 2, wherein the first connection terminal $\mathbf{12}_G$ and the planar periphery portion 1*b* are integrally connected through a bent portion 15 located in the resin mold portion 2.

4. The microphone according to claim 2, wherein a notch portion 2*a* is formed at an outer end of the slit portion in the resin mold portion 2, a thin connection piece 104 having one end integrally connected to the second connection terminal $\mathbf{12}_S$ is extended in the resin mold portion 2, and the other end of the connection piece 104 faces the notch portion 2*a*.

5. The microphone according to claim 1, wherein the external terminal 10 and the ground terminal 11 are flush with the caulking portion 611 or projects toward the planar periphery portion 1*b* with respect to the caulking portion 611.

6. The microphone according to claim 1, wherein in the capsule 57, a conductive coil spring 52 concentric with the capsule 61 is elastically interposed between the rear pole and the substrate, and the an input terminal of the impedance converting circuit and the rear pole are electrically connected together.

7. The microphone according to claim 6, wherein a holder 54 is provided between the coil spring 52 and the capsule 57 to electrically insulate the coil spring 52 from the capsule.

8. A method for manufacturing the substrate for a condenser microphone formed by housing the substrate having at least a diaphragm, a rear pole, and an impedance converting circuit mounted on the substrate, in a metal cylindrical capsule having a sound wave passing opening at one end, through the other end of the capsule, and then caulking the one end of the cylindrical capsule to an outer surface of the substrate to form a caulking portion, to fix parts inside the capsule together the method comprising:

forming a planar periphery portion connected via a thin second connection piece 103 to a frame 102 outside a hole 101 formed in a metal plate, the caulking portion being caulked to one surface of the planar periphery portion;

integrally forming a ring-like ground terminal 11 on an inner side of an outer surface of the planar periphery portion 1*b*, the ring-like ground terminal 11 projecting beyond the thickness of the caulking portion;

forming an external terminal 10 in a central portion of the ring-like ground terminal 11, the external terminal 10 being separated from the ring-like ground terminal 11 and being flush with the ground terminal;

forming at least two slits 1*b* 1 in the planar periphery portion 1*b* and ground terminal 11, the slits 1*b* 1 extending in a radial direction around the external terminal 10;

forming a first connection terminal $\mathbf{12}_G$ between the planar periphery portion 1*b* and the external terminal 10, the first connection terminal $\mathbf{12}_G$ projecting from the planar periphery portion 1*b* in a direction opposite to the external terminal 10 and being connected to the planar periphery portion 1*b* via a first bent portion 15;

a second connection terminal $\mathbf{12}_S$ connected to the external terminal 10 via a second bent portion 14 on the same plane as the first connection terminal $\mathbf{12}_G$ and connected to the frame via a thin second connection piece 104 located opposite and separated from the slits;

then exposing outer surfaces of the external terminal 10, ground terminal 11, first connection terminal $\mathbf{12}_G$, second connection terminal $\mathbf{12}_S$, and planar periphery portion and filling and molding a resin material to form a planar resin mold portion 2 having a notch portion located at an outer end of each of the slits; and cutting the first connection piece 103 at a position where the first connection piece 103 is connected to the planar periphery portion and cutting the second connection piece 104 at a position of the notch portion to separate the first connection piece 103 and the second connection piece 104 from the frame to obtain the substrate.

9. The manufacturing method according to claim 8, wherein a state prior to formation of the resin mold portion 2 is formed by punching and pressing the metal plate.

10. The manufacturing method according to claim 8, wherein a state prior to formation of the resin mold portion 2 is formed by etching the metal plate.

* * * * *